US007333128B2

(12) United States Patent
Yoon

(10) Patent No.: US 7,333,128 B2
(45) Date of Patent: Feb. 19, 2008

(54) LASER SHUTTING DEVICE AND LASER SCANNING UNIT EMPLOYING THE SAME

(75) Inventor: In-ho Yoon, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 188 days.

(21) Appl. No.: 11/169,740

(22) Filed: Jun. 30, 2005

(65) Prior Publication Data

US 2006/0018670 A1 Jan. 26, 2006

(30) Foreign Application Priority Data

Jul. 20, 2004 (KR) ..... 10-2004-0056423

(51) Int. Cl.
*B41J 15/14* (2006.01)
*G03G 15/00* (2006.01)

(52) U.S. Cl. ..... 347/241; 399/4

(58) Field of Classification Search ..... 347/262, 347/241; 335/223; 399/4
See application file for complete search history.

(56) References Cited

U.S. PATENT DOCUMENTS 2,375,100 A * 5/1945 Gibbon ..... 335/223
5,402,153 A * 3/1995 Agano ..... 347/262
5,535,052 A * 7/1996 Jorgens ..... 359/388
2002/0165525 A1* 11/2002 Nakamura ..... 606/4

FOREIGN PATENT DOCUMENTS

| | | | |
|---|---|---|---|
| JP | 58-126548 | | 7/1983 |
| JP | 59101041 A | * | 6/1984 |
| JP | 06-148548 | | 5/1994 |
| JP | 09-189874 | | 7/1997 |
| JP | 2001-133719 | | 5/2001 |
| KR | 1020040019792 A | | 3/2004 |

* cited by examiner

*Primary Examiner*—Hai Pham
*Assistant Examiner*—Carlos A. Martinez, Jr.
(74) *Attorney, Agent, or Firm*—Roylance, Abrams, Berdo & Goodman, L.L.P.

(57) ABSTRACT

A laser shutting device blocks laser beams in a laser scanning unit that includes a light source that emits laser beams and a beam deflecting unit that deflects the laser beams in a main-scanning direction and is adapted to form an image on a photosensitive body using the laser beams. The laser shutting device includes a shutter movably installed in a light path between the light source and the photosensitive body, an opening formed in the shutter that allows the laser beams to pass therethrough, and a laser shutting unit that moves the shutter using an electromagnet according to a start signal for operating the beam reflecting unit so that the laser beams can pass through the opening.

18 Claims, 6 Drawing Sheets

LASER SHUTTING DEVICE AND LASER SCANNING UNIT EMPLOYING THE SAME

BACKGROUND OF THE INVENTION

This application claims the benefit under 35 U.S.C. § 119(a) of Korean Patent Application No. 10-2004-0056423, filed on Jul. 20, 2004, in the Korean Intellectual Property Office, the entire disclosure of which is hereby incorporated by reference.

FIELD OF THE INVENTION

The present invention relates to a laser shutting device and a laser scanning unit employing the same. More particularly, the present invention relates to a laser shutting device that uses an electromagnet and a laser scanning unit employing the laser shutting device.

DESCRIPTION OF THE RELATED ART

Laser scanning units (LSUS) are image forming apparatuses that scan information using laser beams on a photosensitive body in an electrophotographic printer, such as a laser printer, to form an image. FIG. 1 is a schematic diagram of a typical laser scanning unit. As shown in FIG. 1, a typical laser scanning unit generally includes a light source 11, such as a laser diode, a collimating lens 12, a cylindrical lens 14, a beam deflecting unit 15, a scanning optical lens 16, a photosensitive drum 18, and synchronizing signal detecting units 19, 20, and 21. In a laser scanning unit constructed in such a manner, laser beams emitted from the light source 11 are reformed into parallel beams by the collimating lens 12. The parallel beams are converged in a sub-scanning direction while passing through the cylindrical lens 14. Thereafter, the converged beams are deflected in a main-scanning direction, that is, a horizontal direction of a sheet of paper, by the beam deflecting unit 15 that rotates at high speed. The deflected beams pass through the scanning optical lens 16 and form an image on the photosensitive drum 18. To this end, the beam deflecting unit 15 includes a beam deflecting mirror 15*a* for reflecting the converged beams in the main-scanning direction, and a scanner motor 15*b* for rotating the beam deflecting mirror 15*a*. In general, the beam deflecting mirror 15*a* is a polygon mirror with a polygonal surface.

Since printers, such as laser printers employing the laser scanning unit having the above structure, use laser beams, they must be tested for safety before being put on the market. For example, a user may lose his or her sight when laser beams leaking out of a printer are incident on the user's eyes. Therefore, laser beams must not leak out of the printer during operation. To satisfy such safety requirements, a mechanical laser shutting device is generally used to block laser beams when a cover of the printer is opened or a developing unit of the printer is attached or detached.

FIG. 2 is a sectional view of a conventional mechanical laser shutting device coupled to the light scanning unit shown in FIG. 1. As shown in FIG. 2, the conventional mechanical laser shutting device includes a shutter 33 disposed in a light path between the light source 11 and the beam deflecting unit 15, and a lever 31 for moving the shutter 33 up and down. An opening 34 through which the laser beams pass is formed in the shutter 33. Further, the shutter 33 is installed to pass through a frame 40 that surrounds the light scanning unit. An elastic member 32 for sealing a gap between the frame 40 and the shutter 33 is attached to the lever 31.

FIGS. 3A and 3B are sectional views of the conventional laser shutting device shown in FIG. 2 that illustrate the operation of the laser shutting device. If a cover of a printer is closed and a developing unit resides in the printer, the lever 31 is pressed toward the frame 40 as shown in FIG. 3A. Accordingly, the shutter 33 is positioned so that the opening 34 formed in the shutter 33 can be aligned with a path of the laser beams. Then, the laser beams emitted from the light source 11 pass through the opening 34 and reach the beam deflecting unit 15.

On the other hand, if the cover of the printer is opened or the developing unit is removed from the printer, the lever 31 is separated from the frame 40 as shown in FIG. 3B. Then, the shutter 33 is lowered due to its weight. As a result, the opening 34 formed in the shutter 33 is misaligned with the path of the laser beams, such that the laser beams are blocked. Accordingly, if the cover of the printer is opened or the developing unit of the printer is removed from the printer, the laser beams are blocked by the shutter 33, and thus, the laser beams are prevented from leaking out of the printer.

However, the conventional laser shutting device has some disadvantages. In general, if the printer, such as a laser printer, is turned on, the light source 11 in the printer is always "ON" irrespective of the printing process. Accordingly, the laser beams emitted from the light source 11 are always incident on the beam deflecting unit 15 irrespective of the printing process. There are instances, depending on the angle of the beam deflecting mirror, where an image is formed on the photosensitive drum 18 due to the laser beams. The image formation may adversely affect the function of the developing unit.

Furthermore, the mechanical laser shutting device described above is relatively susceptible to malfunction. If the laser shutting device does not operate normally, although a user opens the cover of the printer, or attaches or detaches the developing unit from the printer, the lever 31 may not be separated from the frame 40. If the printer is "ON" at this time, there is a risk that the shutter 33 will fail to block the laser beams emitted from the light source 11 and the laser beams may leak out of the printer.

Accordingly, there is a need for an improved laser shutting device for blocking laser beams in an image forming apparatus.

SUMMARY OF THE INVENTION

An aspect of the present invention is to solve at least the above problems and/or disadvantages and to provide at least the advantages described below. Accordingly, an aspect of the present invention is to provide a laser shutting device which can safely protect a user from laser beams emitted from a light source by blocking the laser beams during a printing operation of a printer, and a laser scanning unit employing the laser shutting device.

According to an aspect of the present invention, a laser scanning unit with a light source that emits laser beams and a beam deflecting unit that deflects the laser beams in a main-scanning direction to form an image on a photosensitive body using the laser beams includes a laser shutting device for blocking laser beams. The laser shutting device comprises a shutter movably installed in a light path between the light source and the photosensitive body, an opening formed in the shutter that allows the laser beams to pass through the shutter, and a laser shutting unit that moves the shutter according to a start signal for operating the beam reflecting unit so that the laser beams can pass through the opening.

The laser shutting unit may comprise a ferromagnetic plate attached to one side of the shutter, an electromagnet that receives the start signal and attracts the ferromagnetic plate when the start signal is received, and an elastic member that is coupled between the ferromagnetic plate and the electromagnet.

The laser shutting unit may further comprise an electromagnet driving unit that receives the start signal and supplies power to the electromagnet. The electromagnet driving unit may cut off the power supply to the electromagnet when the operation of the beam deflecting unit stops.

According to another aspect of the present invention, a laser scanning unit comprises a light source that emits laser beams, a beam deflecting unit that deflects the laser beams in a main-scanning direction, a photosensitive body on which the deflected laser beams form an image, and a laser shutting device that prevents the laser beams from leaking out. The laser shutting device comprises a shutter movably installed in a light path between the light source and the photosensitive body, an opening formed in the shutter that allows the laser beams to pass through the shutter, and a laser shutting unit that moves the shutter according to a start signal for operating the beam deflecting unit so that the laser beams can pass through the opening.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
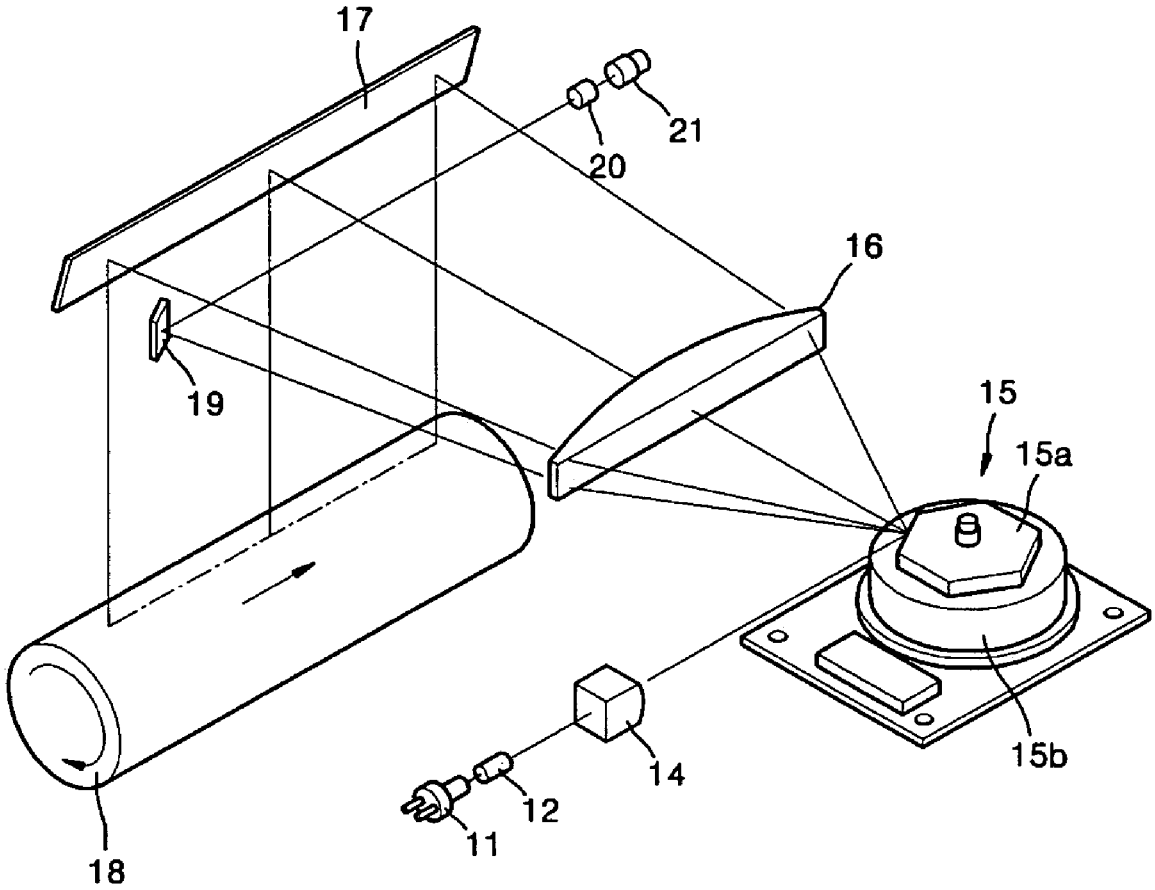
FIG. 1 is a schematic diagram of a conventional laser scanning unit.
Figure 2:
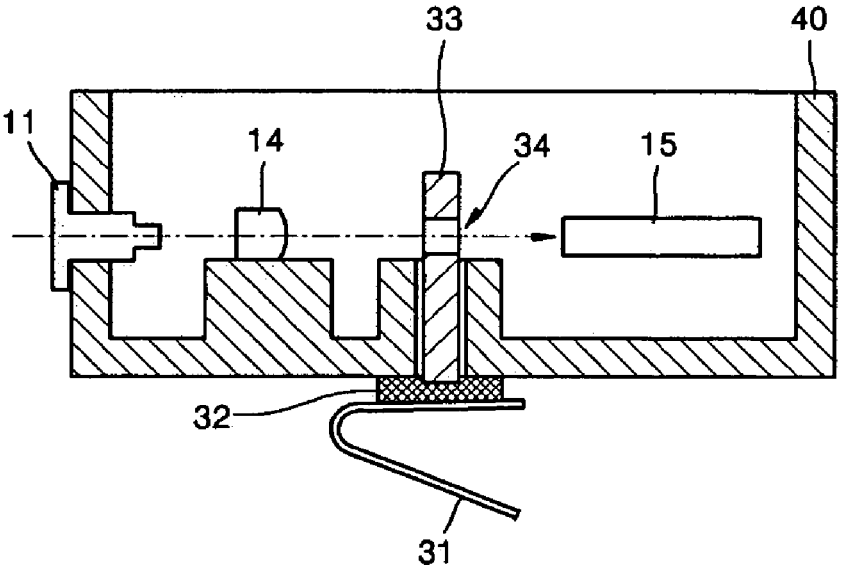
FIG. 2 (PRIOR ART)
FIG. 2 is a sectional view of a conventional mechanical laser shutting device coupled to the laser scanning unit shown in FIG. 1.
Figure 3A:
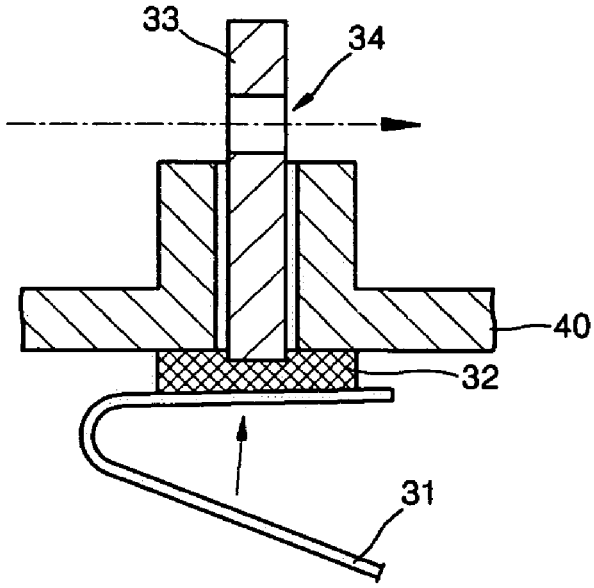
FIG. 3A (PRIOR ART)
FIGS. 3A and 3B are sectional views of the conventional mechanical laser shutting device shown in FIG. 2 that illustrate the operation of the laser shutting device.
Figure 3B:
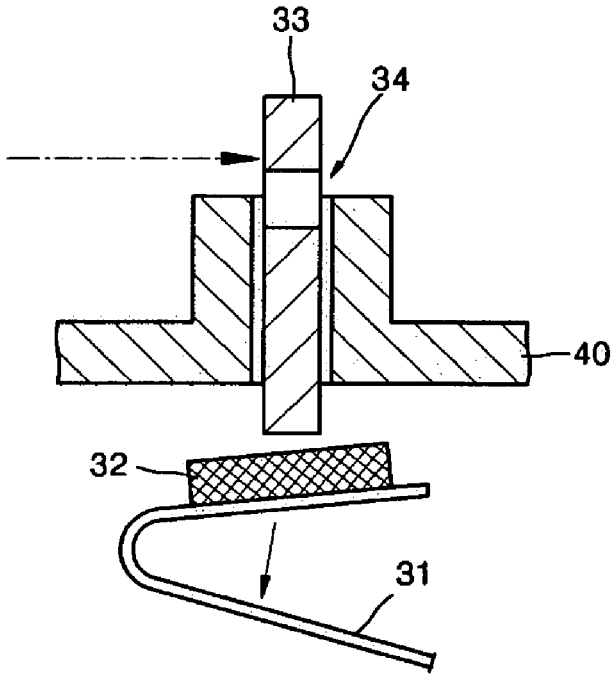
FIG. 3B (PRIOR ART)
Figure 4:
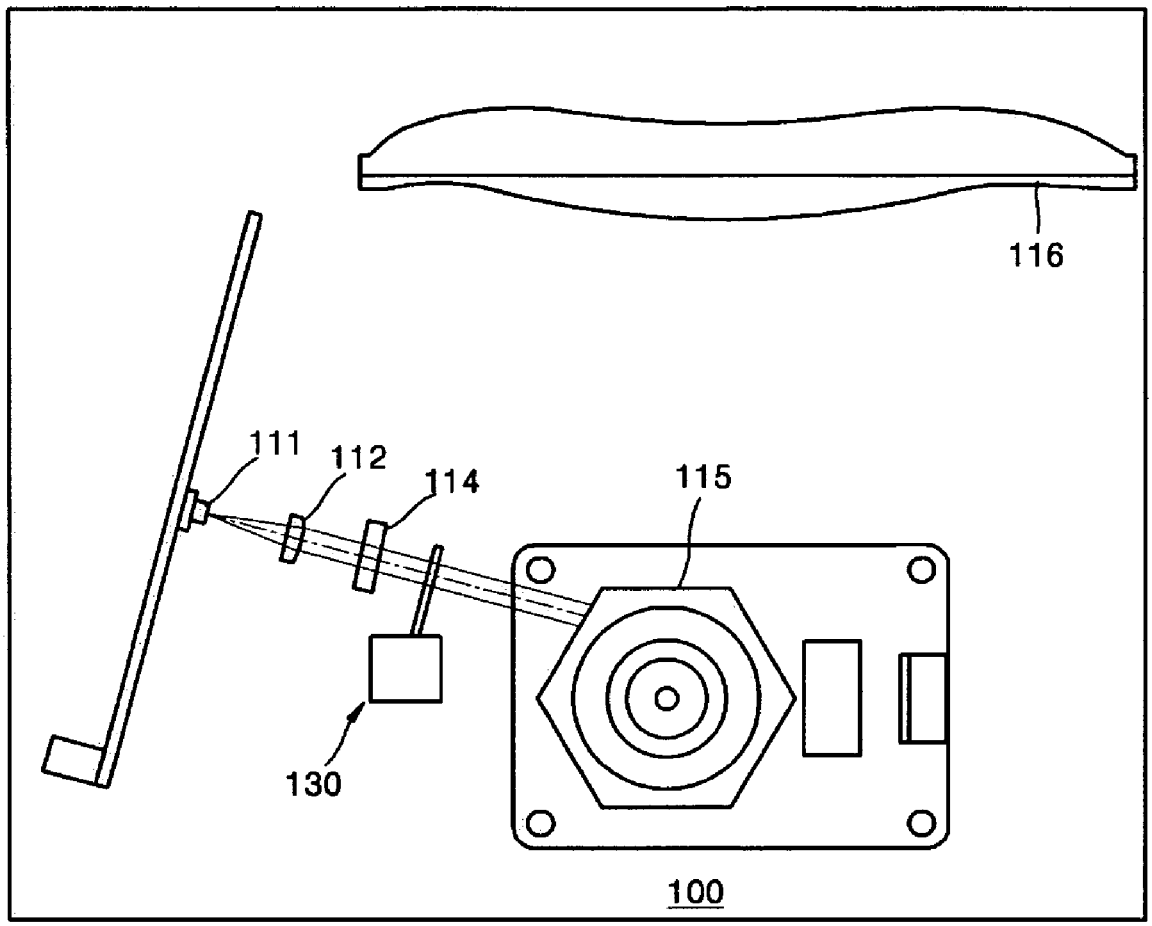
FIG. 4 is a plan view of a laser shutting device installed in a light path of a laser scanning unit according to an embodiment of the present invention.

FIG. 4 is a plan view of a laser shutting device installed in a light path of a laser scanning unit 100 according to the present invention. As shown in FIG. 4, a laser shutting device 130 is installed between a light source 111, such as a laser diode, and a beam deflecting unit 115. Although the laser shutting device 130 is installed between a cylindrical lens 114 and the beam deflecting unit 115 in FIG. 4, the laser shutting device 130 may be installed between a collimating lens 112 and the cylindrical lens 114, or between the light source 111 and the collimating lens 112. The laser shutting device 130 may also be installed between a scanning optical lens 116 and the beam deflecting unit 115, or, more generally, between a photosensitive drum (not shown) and the beam deflecting unit 115.

Figure 5:
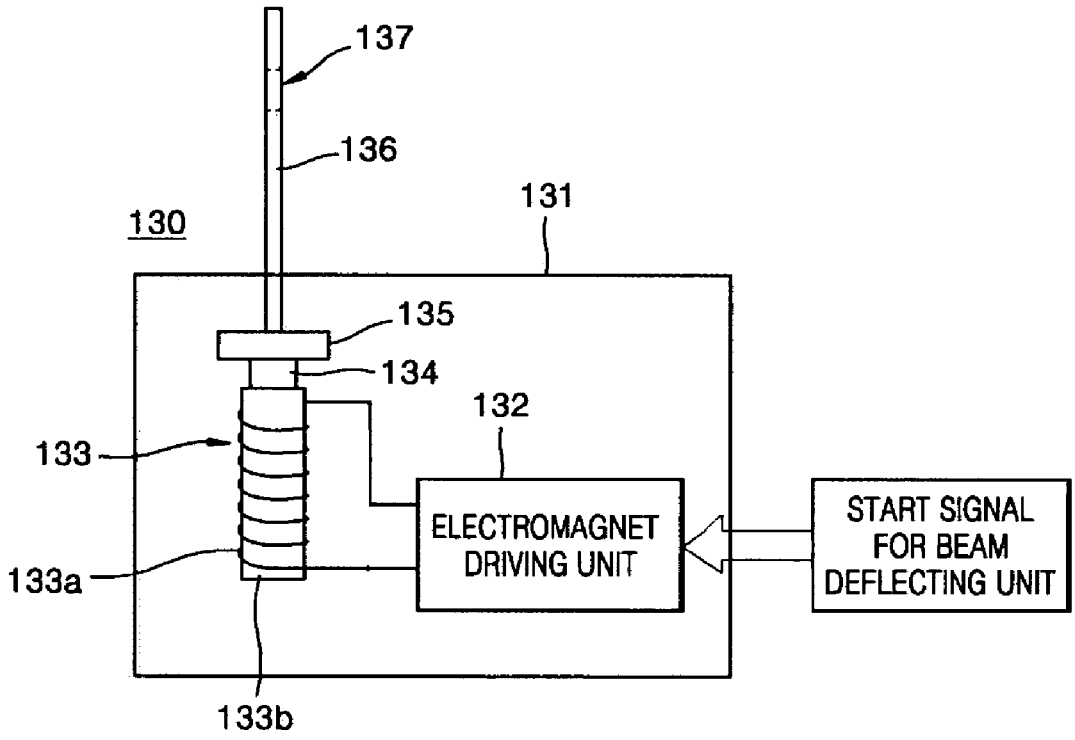
FIG. 5 is an enlarged view of the laser shutting device shown in FIG. 4 according to an embodiment of the present invention.

FIG. 5 is an enlarged view of the laser shutting device shown in FIG. 4 according to an embodiment of the present invention. As shown in FIG. 5, the laser shutting device 130 includes a shutter 136 that is movably installed between the light source 111 and the beam deflecting unit 115. An opening 137 is formed in one side of the shutter 136 and allows laser beams emitted from the light source 111 to pass through the shutter. A laser shutting unit 131 receives a start signal input to the beam deflecting unit 115 and moves the shutter 136. In the illustrated embodiment, the start signal is a signal for driving a motor of the beam deflecting unit 115. When the beam deflecting unit 115 receives the start signal, it rotates the motor to deflect the laser beams in a main-scanning direction. In the exemplary embodiment of the present invention described here, the start signal for the beam deflecting unit 115 is also used as a start signal for the laser shutting device 130.

The shutter 136 may have a bar shape that blocks the light path between the light source 111 and the beam deflecting unit 115. The shutter 136 is installed so that it moves substantially perpendicular to the light path. Further, the opening 137 in the shutter 136 has a diameter that is large enough for the laser beams emitted from the light source 111 to pass through the opening.

If the laser shutting unit 131 (that receives the start signal input to the beam deflecting unit 115) moves the shutter 136 so that the opening 137 is aligned with the light path, the laser beams pass through the shutter 136 and reach the beam deflecting unit 115. On the other hand, if the opening 137 is not aligned with the light path, the laser beams are blocked by the shutter 136, and thus, cannot reach the beam deflecting unit 115.

As shown in FIG. 5, the laser shutting unit 131 includes a ferromagnetic plate 135 that is attached to the other side of the shutter 136, an electromagnet 133 that attracts the ferromagnetic plate 135 when receiving the start signal input to the beam deflecting unit 115, and an elastic member 134 that is coupled between the ferromagnetic plate 135 and the electromagnet 133. The laser shutting unit 131 may further include an electromagnet driving unit 132 that receives the start signal and supplies power to the electromagnet 133.

The ferromagnetic plate 135 is a thin plate made of material having magnetic properties. For example, the ferromagnetic plate 135 can be made of iron, cobalt, or an alloy thereof. As shown in FIG. 5, the ferromagnetic plate 135 may be attached to one end of the shutter 136. If voltage is applied to the electromagnet 133 (that is formed by winding a coil 133*a* around a core 133*b* several times), a magnetic field is generated and the electromagnet 133 attracts the ferromagnetic plate 135. Furthermore, the elastic member 134 coupled between the ferromagnetic plate 135 and the electromagnet 133 enables the ferromagnetic plate 135 to return to its original position due to a restoring force if the power supply to the electromagnet 133 is cut off. The elastic member 134 may be a spring.

Figure 6A:
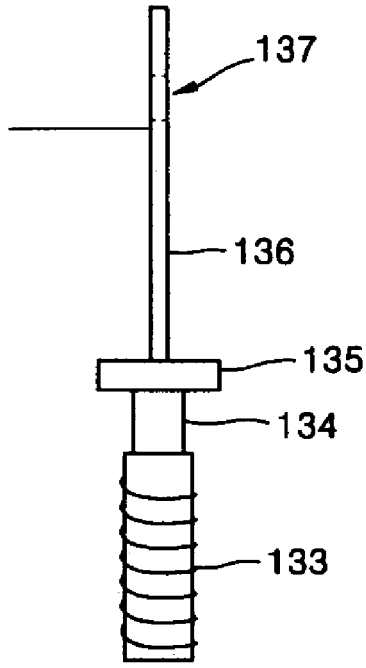
FIGS. 6A and 6B are diagrams of the laser shutting device shown in FIG. 5 that illustrate the operation of the laser shutting device.
Figure 6B:
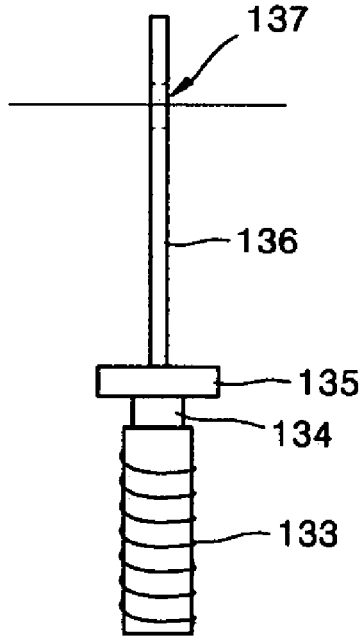

The operation of the laser shutting device according to the present invention will be explained in detail with reference to FIGS. 6A and 6B.

Even though the laser beams are emitted from the light source 111, the beam deflecting unit 115 does not operate when the printer is not performing a printing operation. Accordingly, the laser beams emitted from the light source 111 are not deflected in the main-scanning direction by the beam deflecting unit 115. In this case, as shown in FIG. 6A, the shutter 136 of the laser shutting device 130 is positioned to block the laser beams. Consequently, the laser beams emitted from the light source 111 are blocked by the shutter 136, and cannot reach the beam deflecting unit 115. Accordingly, while the printing operation of the printer is not performed, the present invention prevents unnecessary laser beams from being reflected by a beam deflecting mirror of the beam deflecting unit 115 to form an image on the photosensitive drum.

On the other hand, when a printing operation is performed, the motor of the beam deflecting unit 115 rotates at high speed. At this time, the beam deflecting mirror that rotates at high speed along with the motor deflects the laser beams in the main-scanning direction. In general, a control unit (not shown) of the printer transfers a start signal to the beam deflecting unit 115 in order to operate the motor of the beam deflecting unit 115. The beam deflecting unit 115 receives the start signal and applies voltage to the motor. According to the present invention, the start signal that is generated by the control unit is also transmitted to the electromagnet driving unit 132 of the laser shutting device 130. If the electromagnet driving unit 132 receives the start signal, the electromagnet driving unit 132 applies voltage to the electromagnet 133. A magnetic field is created on the electromagnet 133. As shown in FIG. 6B, the ferromagnetic plate 135, such as an iron plate, is attracted toward the electromagnet 133. At this time, the shutter 136 having one end attached to the ferromagnetic plate 135 is also attracted toward the electromagnet 133, and the opening 137 formed in the shutter 136 is positioned in the light path of the laser beams. As a consequence, the laser beams pass through the shutter 136 and are deflected in the main-scanning direction by the beam deflecting unit 115 to form an image on the photosensitive drum.

When the printing operation ends, the electromagnet driving unit 132 cuts off the power supply to the electromagnet 133. Accordingly, the electromagnet 133 stops creating a magnetic field, and thus, removes the attractive force between the electromagnet 133 and the ferromagnetic plate 135. Then, as shown in FIG. 6A, the elastic member 134 that is contracted between the electromagnet 133 and the ferromagnetic plate 135 returns to its original size due to its restoring force and pushes the shutter 136 to its original position. Accordingly, the opening 137 and the light path are not aligned with each other, and the laser beams are blocked by the shutter 136.

As described above, the laser shutting device 30 permits the laser beams to pass through only while the printing operation of the printer is performed, and blocks the laser beams in other cases. As a result, the laser shutting device 130 protects users in a more reliable manner.

Figure 7:
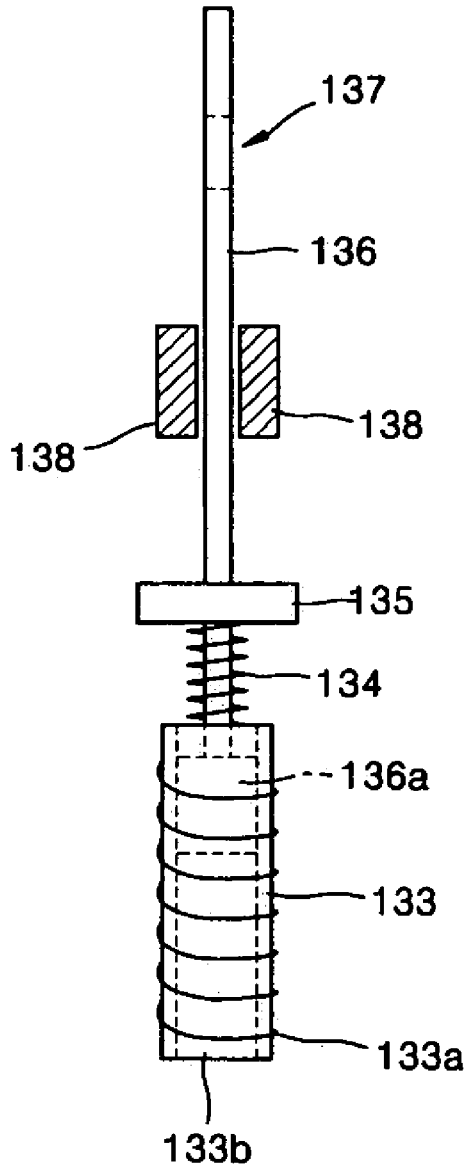
FIG. 7 is a schematic diagram of a laser shutting device according to another embodiment of the present invention.

FIG. 7 is a schematic diagram of a laser shutting device according to another embodiment of the present invention. When the laser shutting device 130 in the embodiment illustrated in FIGS. 5, 6A, and 6B moves the shutter 136 using the electromagnet 133, the shutter 136 may be shaken from side to side or inclined to one side, thereby causing the opening 137 to be partially misaligned with the light path. In this case, a part of the laser beams is blocked by the shutter 136 and cannot reach the beam deflecting unit 115. Accordingly, it is necessary to prevent the shutter 136 from being shaken or inclined during the operation of the laser shutting device 130.

To this end, as shown in FIG. 7, guides 138 may be installed on both surfaces of the shutter 136. The guides 138 may extend from an inner surface of a case of the printer or the laser scanning unit. According to the present embodiment, when the shutter 136 moves due to the operation of the laser shutting device 130, the shutter 136 slides along the guides 138. Accordingly, the shutter 136 hardly shakes or inclines. Further, as shown in FIG. 7, the core 133*a* of the electromagnet 133 may have a cylindrical shape, and one end portion 136*a* of the shutter 136 may be inserted to a predetermined depth into the core 133*a*. Here, it is preferable that the diameter of the one end portion 136*a* of the shutter 136 that is inserted into the core 133*a* is close to the inner diameter of the core 133*a* for the length of the one end portion 136*a* of the shutter 136 so that it does not interrupt the movement of the shutter 136. In this case, the shutter 136 is made of material that is not affected by a magnetic field. In the meantime, the ferromagnetic plate 135 has a ring shape surrounding the shutter 136.

As described above, since the laser shutting device including the electromagnet operates according to the start signal for the beam deflecting unit, leakage of the laser beams due to improper operation can be efficiently prevented. As a result, the laser shutting device can protect users from the laser beams of the printer more safely.

While the invention has been shown and described with reference to certain embodiments thereof, it will be understood by those skilled in the art that various changes in form and details may be made therein without departing from the spirit and scope of the invention as defined by the appended claims.

What is claimed is:

1. A laser shutting device for blocking laser beams in a laser scanning unit that includes a light source that emits laser beams and a beam deflecting unit that deflects the laser beams in a main-scanning direction, and is adapted to form an image on a photosensitive body using the laser beams, the laser shutting device comprising:

a shutter movably installed in a light path between the light source and the photosensitive body;

an opening formed in the shutter that allows the laser beams to pass therethrough; and a laser shutting unit that moves the shutter according to a start signal for operating the beam reflecting unit so that the laser beams can pass through the opening.

2. The laser shutting device of claim 1, wherein the laser shutting unit comprises:

a ferromagnetic plate attached to one side of the shutter;

an electromagnet that attracts the ferromagnetic plate when receiving the start signal; and an elastic member coupled between the ferromagnetic plate and the electromagnet.

3. The laser shutting device of claim 2, wherein the laser shutting unit further comprises:

an electromagnet driving unit that receives the start signal and supplies power to the electromagnet.

4. The laser shutting device of claim 2, wherein the electromagnet driving unit cuts off the power supply to the electromagnet when the operation of the beam deflecting unit stops.

5. The laser shutting device of claim 2, wherein the elastic member is a spring member.

6. The laser shutting device of claim 2, wherein the shutter is movable substantially perpendicular to the light path between the light source and the beam deflecting unit.

7. The laser shutting device of claim 2, wherein the electromagnet comprises a cylindrical core and a coil wound around the core, and an end portion of the shutter is inserted to a predetermined depth into the core.

8. A laser scanning unit comprising:

a light source that emits laser beams;

a beam deflecting unit that deflects the laser beams in a main-scanning direction;

a photosensitive body on which the deflected laser beams form an image; and a laser shutting device that prevents the laser beams from leaking out, the laser shutting device comprising:

a shutter movably installed in a light path between the light source and the photosensitive body;

an opening formed in the shutter that allows the laser beams to pass therethrough; and a laser shutting unit that moves the shutter according to a start signal for operating the beam deflecting unit so that the laser beams can pass through the opening.

9. The laser scanning unit of claim 8, wherein the laser shutting unit comprises:

a ferromagnetic plate attached to one side of the shutter;

an electromagnet that attracts the ferromagnetic plate when receiving the start signal; and an elastic member coupled between the ferromagnetic plate and the electromagnet.

10. The laser scanning unit of claim 9, wherein the laser shutting unit further comprises:

an electromagnet driving unit that receives the start signal and supplies power to the electromagnet.

11. The laser scanning unit of claim 9, wherein the electromagnet driving unit cuts off the power supply to the electromagnet when the operation of the beam deflecting unit stops.

12. The laser scanning unit of claim 9, wherein the elastic member is a spring member.

13. The laser scanning unit of claim 9, further comprising:

guides installed on both surfaces of the shutter to prevent the shutter from being shaken.

14. The laser scanning unit of claim 8, further comprising:

a collimating lens located in the light path between the light source and the photosensitive body; and a cylindrical lens located in the light path between the light source and the photosensitive body.

15. The laser scanning unit of claim 14, wherein the laser shutting device is located between the cylindrical lens and beam deflecting unit.

16. A laser scanning unit comprising:

a light source that emits laser beams;

a rotating polygonal mirror driven by a motor that deflects the laser beams generated by the light source; and a laser shutting device that blocks the laser beams, the laser shutting device comprising:

a shutter movably installed in the path of the laser beams emitted by the light source, the shutter having an opening to allow the laser beams to pass through the shutter; and a laser shutting unit that moves the shutter between an open position where the laser beams can pass through the opening and a closed position where the shutter blocks the path of the laser beams, the laser shutting unit moving the shutter to the open position in accordance with a start to operate the motor for the polygonal mirror.

17. The laser scanning unit according to claim 16, wherein the laser shutting unit includes an electromagnetic coil for moving the shutter.

18. The laser scanning unit according to claim 17, further comprising an electromagnet driving unit that receives the start signal motor for the polygonal mirror and supplies power to the electromagnet.

* * * * *